United States Patent [19]

Achelpohl

[11] 3,952,479

[45] Apr. 27, 1976

[54] MACHINE FOR SLIDING VALVED SACKS ONTO THE FILLING NIPPLE OF A FILLING MACHINE

[75] Inventor: Fritz Achelpohl, Lengerich of Westphalia, Germany

[73] Assignee: Windmoller & Holscher, Lengerich of Westphalia, Germany

[22] Filed: Dec. 26, 1974

[21] Appl. No.: 536,473

[30] Foreign Application Priority Data

Jan. 4, 1974 Germany ..... 2400265

[52] U.S. Cl. ..... 53/187; 53/384; 53/386; 141/166

[51] Int. Cl.[2] ..... B65B 43/12; B65B 43/30

[58] Field of Search ..... 53/187, 188, 384, 386; 141/68, 166, 315

[56] References Cited

UNITED STATES PATENTS 3,190,049 6/1965 Van der Meulen ..... 53/187 X 3,213,588 10/1965 Peterson ..... 53/384 X

*Primary Examiner*—Travis S. McGehee

*Attorney, Agent, or Firm*—Fleit & Jacobson

[57] ABSTRACT

Sacks having a filling valve at the top are successively taken from a storage station and pushed onto the outlet nipple of a filling machine by an apparatus comprising storage means for the sacks and means for separating the sacks and feeding them in a vertical position to tong means which are displaceable on a guide between the feeding means and the nipple and engage each sack below the valve. The feeding means comprise a double belt conveyor and, parallel thereto at the level of the valve, a double suction belt for pre-opening the valve, the tong means including fingers which engage in the pre-opened valve.

8 Claims, 4 Drawing Figures

MACHINE FOR SLIDING VALVED SACKS ONTO THE FILLING NIPPLE OF A FILLING MACHINE

The invention relates to a machine for sliding valved sacks onto the filling nipple of a filling machine, comprising storage means for valved sacks, means for feeding separated sacks in a vertical position with the valve disposed at the upper end of the sack to tong means which run on a guide between the feeding means and the filling nipple, are provided with means for opening the valve, and the holding tongs of which engage below the valve, take over the sack and push it onto the filling nipple that is parallel to the guide.

In a machine of this kind known from U.S. Pat. No. 3,691,715, a pivotable gripper provided with suction cups takes over the sacks which stand up vertically on their side pleats in a magazine, and inserts them in the holding tongs whilst turning them through 90°. With this known apparatus the valve provided in the cross-bottom is opened by pulling it open with the aid of a suction cup provided in the displaceable tong means. There is a danger of interruptions in the operating sequence if withdrawal from the sack magazine by means of the suckers and opening of the valve with the aid of the suckers are not carried out properly.

Opening of the valves only with the aid of suckers is certainly problematic. For this reason it has been attempted to open the valves of the sacks without the aid of suckers. Such an opening apparatus is known for example from German Gebrauchsmuster Specification No. 7,243,009, in which the sack that is folded to arrow shape by bending the side portions of the cross-bottom onto the side walls of the sack is pushed with the point of the arrow foremost into a spreading apparatus in which the springy side portions of the cross-bottom assume a roof shape and rest on their lower edges. Opening of the valve takes place in the spreading apparatus by pulling on the sack which is suspended in the spreading apparatus. This type of valve opening is also problematic because it is effected by upsetting the sack material.

Opening of the valve in the cross-bottom by pushing the flat crossbottom upwardly is known for example from U.S. Pat. Nos. 3,212,588 and 3,287,879, the opening operation in the apparatus of U.S. Pat. No. 3,287,879 being assisted by suckers.

The object of the present invention is to provide an apparatus for sliding valved sacks onto the filling nipple of filling machines, which apparatus ensures simple and reliable feeding of the sacks and opening of the valves.

In a machine of the aforementioned kind, this object is fulfilled in accordance with the invention in that for the purpose of feeding the separated sacks to the tong means there is provided a double belt conveyor which passes about vertical axes and a double suction belt for opening the valve runs parallel to the double belt conveyor at the level of the valve in the side wall of the sack, and that the tong means include spreading tongs carrying fingers which engage in the pre-opened valve. The sacks, which are supplied to the double belt conveyor in any suitable manner, are taken over by the tong means in the correct position whilst the valve is pre-opened, the spreading tongs spreading the valve fully so that the valved sack will be reliably pushed over the filling nipple. As soon as the valved sack has been pushed onto the filling nipple, the holding tongs open and the spreading tongs move out of the valve opening so that the tong means can be moved back to take over a new sack.

In machines of the aforementioned kind, a particular problem is also the storage of the valved sacks and their separation for the purpose of filling. A development of the invention provides that the valved sacks are stored in a roll suspended in an unwinding apparatus, that a pair of feed rolls or a double belt conveyor for feeding the withdrawn web of consecutive sacks introduces each leading sack into the double belt conveyor which leads to the tong means and the drive and/or direction-changing rolls of which are separable in the sequence of the sack feed to form a gap between the belts, and that a severing or tear-off apparatus is provided for severing each sack supplied to the double belt conveyor. The manufacture of the rolls of sacks is the subject of Applicants' prior Application No. P 23 62 613.3. For the purpose of separating the sacks, the coiled web of valved sacks must be provided with transverse severing cuts between two transverse weld seams belonging to consecutive sacks, or the individual sacks can be torn from the web if lines of perforations are provided between the two transverse weld seams. The apparatus operating with a roll of sacks in accordance with the invention is much simpler when compared with known apparatuses because the usual magazines and means for separating the sacks stacked in the magazine can be dispensed with. In the case where lines of perforations are provided between the individual sacks, tearing off of the sacks may also be carried out by the double belt conveyor which will be appropriately designed.

To enable the valved sack, which is preferably fed in a vertical position, to be supplied to the double belt conveyor in a simple manner, the direction-changing and/or drive rolls of the latter are desirably mounted on pivotable levers which can be swung towards and away from one another by pneumatic piston-cylinder units. The conveying belts of the double belt conveyor that exert pressure on one another can be separated to form a continuous gap but it is also possible to separate only the rolls at the inlet side so that a wedge-shaped gap is formed.

The tong means preferably travel on a guide tube and are supported by a roller on a beam extending parallel to the tube. The pivotally mounted jaws of the tongs may be coupled by inter-engaging gear segments, one jaw being connected to a lever which projects beyond its pivot and which carries a roller running on a cam track.

An example of the invention will now be described in more detail with reference to the drawing. In the drawing.

Figure 1:
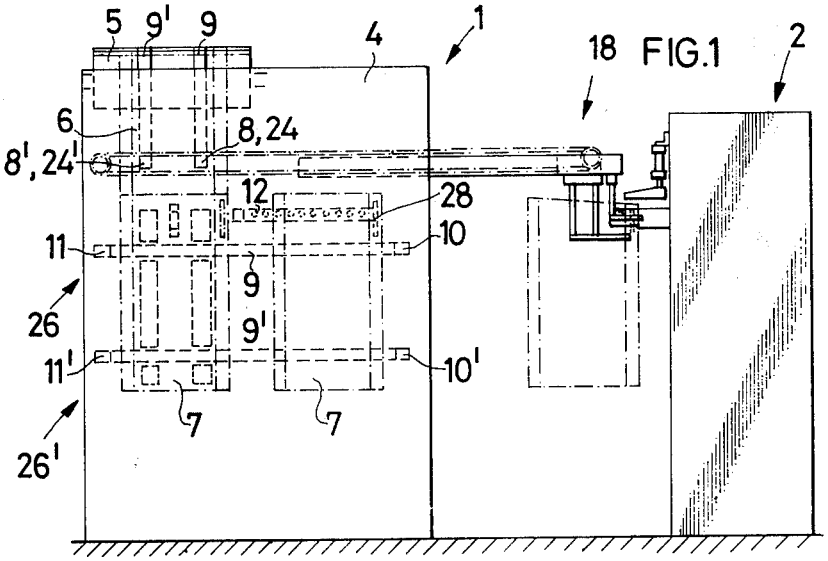
FIG. 1 is a diagrammatic front elevation.
Figure 2:
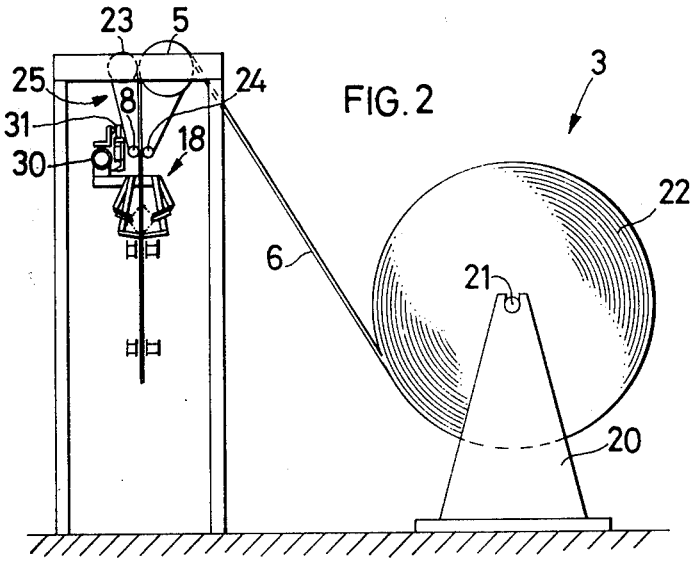
FIG. 2 is a diagrammatic side elevation.
Figure 3:
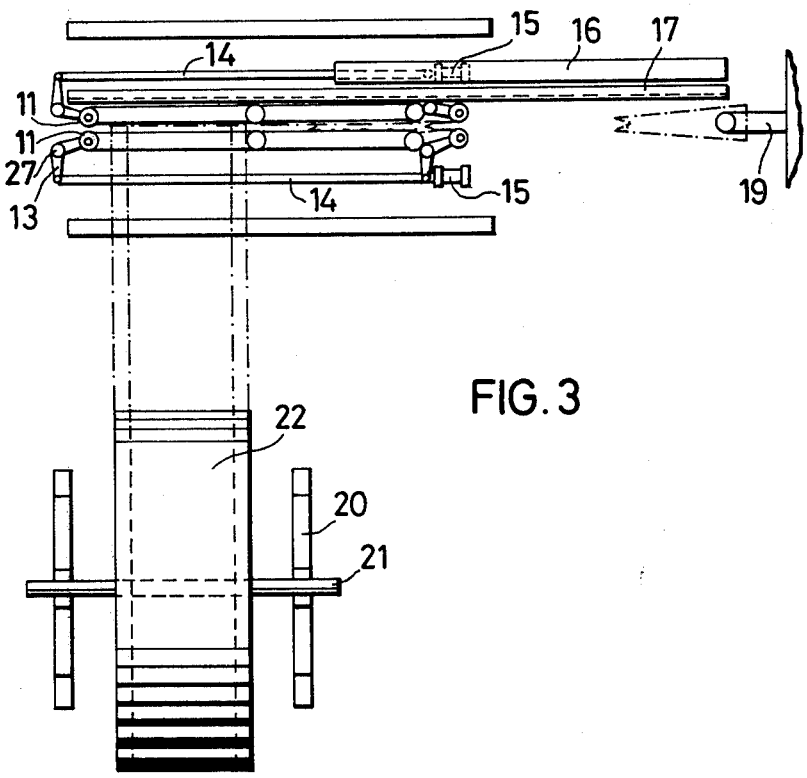
FIG. 3 is a diagrammatic plan view on the machine for sliding on valved sacks comprising a filling automat and storage roll unwinding apparatus.

The apparatus 1 for sliding valved sacks 7 onto the filling nipple 19 of an automatic filling machine 2 comprises a machine frame 4 at the top of which a direction-changing roll 5 is rotatably mounted for a web 6 of sacks withdrawn from a storage roll 22. Together with the rolls 23, 8, 8′, 24, 24′ and the belts 9, 9′, the direction-changing roll 5 also forms the double belt conveyor 25 of which the drive is not illustrated. The double belt conveyor 25 inserts the web 6 of sacks in the parallel double belt conveyors 26 and 26'. The direction-changing or drive rolls 10, 10' and 11, 11' of the double belt conveyors 26, 26' are rotatably mounted about vertical axes on the bell crank levers 13. The bell crank levers 13 can be swung about vertical shafts 27 which are fixed to the frame. Hinged to the arm of the bell crank levers 13 that carries no roller are the tension or compression rods 14 which are actuated by the pneumatic piston-cylinder units 15. The drive of the double belt conveyors 26, 26' which serve as feed belts is not illustrated.

Disposed parallel to the double belt conveyors 26, 26' in the region of the valve opening 28 of the valved sacks 7 there is a double suction belt 12 of which the internal belt spacing diverges in the feed direction to pre-open the valve. The double suction belt is formed in known manner by a double belt conveyor with perforated belts which cover elongated suction boxes. The double suction belt 12 extends parallel to the double belt conveyors 26, 26' at approximately the rear half thereof.

A cantilever tubular beam 16 is fixed in the machine frame 4 above the double suction belt 12 and serves as a guide for the tong unit 18 which is displaceable on this beam by means of a tubular sleeve 30. A U beam 17 on which the tong means 18 are supported by the roller 31 extends parallel to the tubular beam 16.

Figure 4:
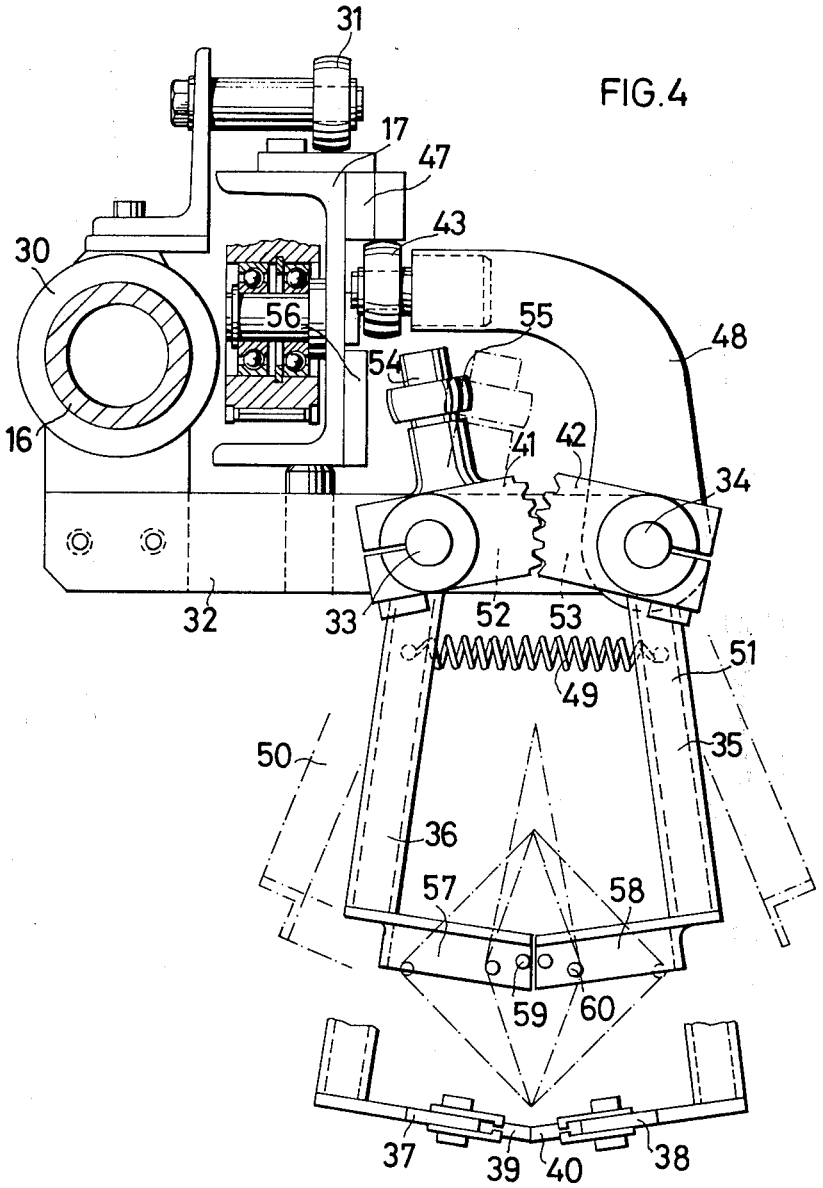
FIG. 4 is an enlarged illustration of the tong means.

The construction of the tong means 18 is shown in more detail in FIG. 4. The supporting frame 32 is welded onto the sleeve which slides on the tubular beam 16. The shafts 33 and 34 carrying at their ends the arms 35, 36 of the holding tongs are mounted in the supporting frame 16. Clamped to the shafts 33, 34 there are the gear segments 41, 42 which mesh with one another and which transmit the pivotal motion of the arm 35 to the arm 36. The arm 35 of the tongs is extended beyond the shaft 34 by the arm 48 which carries the cam roller 43 at its free end. The cam roller 43 runs on the cam track 47 which is fixed to the beam 17. The cam track 47 has an inclination corresponding to the movement of the tongs so that the tongs close after transfer of the sack 7 and open again after sliding onto the mandrel 19. At the end of the arms 35, 36 of the tongs there are bars 37, 38 which interconnect same and which carry rubber bars 39, 40 at the sides facing the sack.

The arms 50, 51 of the spreading tongs are rotatably mounted on the shafts 33, 34. The pivotal movements of both arms are intercoupled by the gear segments 52, 53. Fixed to the gear segment 52 there is the arm 54 which carries the cam roller 55 at its free end. The cam roller 55 runs on the cam track 56 fixed to the beam 17. The arms 50, 51 of the tongs carry at their lower ends the transverse members 57, 58 at the ends of which the fingers 59, 60 are fixed.

The cam tracks 47, 56 may additionally be displaceable to produce more rapid closing and opening of the tongs.

The closing torque emanating from the arms 35, 36 of the tongs and transmitted to the beam 17 by the rollers 31 and 43 is substantially balanced out in the beam.

Opening of the arms 50, 51 of the tongs for spreading the valve opening is effected only by the lever 54 with cam roller 55. Closing of the arms is effected by the spring 49 of which the ends are fixed to the arms 50, 51.

The tong means 18 are displaceable on the beam 16 by drive means which are not illustrated.

The unwinding station 3 consists of the usual stand 20 which carries the roll 22 fitted over the shaft 21. The usual braking and withdrawing apparatuses are not illustrated.

The valved sacks wound on the roll 22 are formed from a tube with side pleats, the valve openings 28 being disposed in one side wall of the tube near one of the side edges. Disposed between the double belt conveyor 25 on the one hand and the double belt conveyors 26, 26' on the other hand, the apparatus 1 includes a severing or tear-off apparatus (not shown in detail) for severing the sacks 7 from the web 6.

The apparatus operates in a manner such that the web 6 of sacks is in each case introduced by the double belt conveyor 25 between the opened belts of the double belt conveyors 26, 26'. By actuating the pneumatic cylinders 15, the belts of the double belt conveyors 26, 26' clamp against the vertically supplied sack 7 and pull it forwardly after it has been separated from the web 6 by an apparatus (not shown). During feeding the valve is pre-opened by the double suction belts 12. The tong means 18 accept the sack 7 in approximately that position in which the righthand sack 7 is located in the apparatus 1 of FIG. 1. After the sack has been taken over by the arms 35, 36 of the tongs with the aid of the clamping bars 39, 40, the belts of the double belt conveyors 26, 26' open again so that the tong means 18 can transport the sack further and push it over the filling nipple 19. During opening of the double belt conveyors 26, 26', a new sack 7 may be introduced simultaneously at the inlet side. The sacks 7 are always taken over by the tong means at the same height so that the decrease in the height of the sacks during spreading of the valve is not detrimental.

During transfer of the sack to the tong unit, the fingers 59, 60 move into the valve opening when they are in a relative position as shown in broken lines in FIG. 4. During feeding of the sack by the tong unit 18, the valve opening is pulled open to its fullest extent in the manner illustrated in chain-dotted lines in FIG. 4. After the valved sack 7 has been pushed onto the filling nipple 19, the tong apparatus 18 continues to move a short distance so that the spreading fingers 59, 60 can move out of the valve opening again.

What I claim is:

1. An apparatus for placing valved sacks onto the filling nipple of a filling machine, comprising storage means for valved sacks having a valve in the side wall of the sack, means for feeding the valved sacks individually in a vertical position with the valve positioned at the upper end of the sack, said feeding means including a double belt conveyor mounted for movement about vertical axes and a double suction belt for opening the valve, said double suction belt mounted for movement parallel to the double belt conveyor at the vertical level of the valve in the side wall of the sack, guide means mounted parallel to the filling nipple, and tong means mounted on the guide means for movement between the feeding means and the filling nipple, said tong means having means for engaging the sack below the valve and spreading tong means carrying finger means for engaging in the pre-opened valve so that the valve is maintained open and placed onto the filling nipple during the movement of said tong means.

2. The apparatus of claim 1 and further comprising means for transferring the valved sacks from the storage means to the feeding means so that the sacks are transferred individually into the feeding means.

3. The apparatus of claim 1 and further comprising means for pivotaly mounting the belts of the double belt conveyor and means for moving the belts of the double belt conveyor toward and away from one another.

4. The apparatus of claim 1 in which the tong means includes pivotally mounted jaws, inter-engaging gear segments coupling the jaws, a lever connected to one jaw which projects beyond its pivot, a roller mounted on the lever and a cam track on which the roller runs.

5. An apparatus for placing valve sacks onto the filling nipple of a filling machine, comprising storage means for storing a roll of valved sacks having a valve in the side wall of the sack, said storage means including an unwinding apparatus for suspending the roll, said roll including a web of consecutive sacks, means for withdrawing the web of consecutive sacks from the roll and introducing each leading sack into a feeding means, means for severing each leading sack from the web supplied to the feeding means, said feeding means feeding the sacks individually in a vertical position with the valve positioned at the upper end of the sack, said feeding means including a double belt conveyor and means for moving the belts of the double belt conveyor relative to one another in the sequence of the sack feeding to form a gap between the belts, guide means mounted parallel to the filling nipple, and tong means mounted on the guide means for movement between the feeding means and the filling nipple, said tong means including means for engaging the sack below the valve, for opening the valve and for placing the valve over the filling nipple.

6. The apparatus of claim 5 in which said means for moving the belts of the double belt conveyor include pivotable levers on which the belts of the double belt conveyor are mounted and which are adapted to be swung towards and away from one another and pneumatic piston-cylinder means for moving the pivotable levers.

7. The apparatus of claim 5 in which the guide means comprises a guide tube and a beam extending parallel to the guide tube and in which said tong means is mounted for movement on said guide tube and is supported by a roller on said beam.

8. The apparatus of claim 5 in which said tong means include pivotally mounted jaws, inter-engaging gear segments coupling the jaws, a lever connected to one jaw which projects beyond its pivot, a roller mounted on the lever and a cam track on which the roller runs.

* * * * *